US011758980B2

(12) United States Patent
Davis

(10) Patent No.: US 11,758,980 B2
(45) Date of Patent: Sep. 19, 2023

(54) SHOELACE PROTECTOR ASSEMBLY

(71) Applicant: Michael Davis, Philadelphia, PA (US)

(72) Inventor: Michael Davis, Philadelphia, PA (US)

( * ) Notice: Subject to any disclaimer, the term of this patent is extended or adjusted under 35 U.S.C. 154(b) by 120 days.

(21) Appl. No.: 17/235,548

(22) Filed: Apr. 20, 2021

(65) Prior Publication Data

US 2022/0330659 A1 Oct. 20, 2022

(51) Int. Cl.
*A43C 9/02* (2006.01)

(52) U.S. Cl.
CPC ..... *A43C 9/02* (2013.01)

(58) Field of Classification Search
CPC ..... A43C 9/02; A43C 9/04; Y10T 24/3789
USPC ..... 24/715.6
See application file for complete search history.

(56) References Cited

U.S. PATENT DOCUMENTS 1,314,723 A 9/1918 Wilson
2,961,727 A * 11/1960 Coffey ..... A43C 9/02 63/29.1
5,649,342 A * 7/1997 D'Andrade ..... A43C 7/005 24/712.2
6,044,527 A 4/2000 Ishida
D438,094 S * 2/2001 Ishii ..... D8/383
D443,816 S 6/2001 Ikeda
D450,570 S 11/2001 Murata
D452,139 S * 12/2001 Murata ..... D8/394
6,338,186 B1 1/2002 Kleinmann
6,427,298 B1 8/2002 Tseng
6,640,870 B2 * 11/2003 Osinga ..... E06B 9/326 24/129 R
7,383,871 B2 * 6/2008 Osinga ..... E06B 9/326 24/115 F
7,784,157 B1 * 8/2010 Short ..... H04M 1/05 24/3.13
8,104,146 B2 * 1/2012 Wen ..... E06B 9/326 24/115 F
8,782,860 B2 * 7/2014 Rogers ..... A43C 7/005 24/336
2005/0132546 A1 * 6/2005 Cheng ..... A43C 9/06 24/715.4
2010/0186205 A1 * 7/2010 Stehman, Jr. ..... A43B 3/34 24/715.4
2013/0117975 A1 * 5/2013 Herrera ..... A43B 3/38 24/715.4
2013/0340764 A1 * 12/2013 Atkinson ..... A61M 25/02 128/207.18
2015/0052713 A1 * 2/2015 Hannan ..... A43C 9/02 24/712
2019/0320761 A1 * 10/2019 Mills ..... A43C 9/02

* cited by examiner

*Primary Examiner* — Robert Sandy
*Assistant Examiner* — Louis A Mercado

(57) ABSTRACT

A shoelace protector assembly for protecting an aglet on a shoelace includes a first housing that has a first slot integrated into the first housing to insertably receive an aglet on a shoelace. A hinge is hingedly coupled to the first housing, and the hinge is biased into an open position. A second housing is provided, and a second slot is integrated into the second housing. The second housing is coupled to the hinge, such that the second housing is hingedly retained on the first housing. The second housing is positionable in a closed position, having the second slot and the first slot form a well to enclose the aglet of the shoelace.

1 Claim, 4 Drawing Sheets

SHOELACE PROTECTOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protector devices and more particularly pertains to a new protector device for protecting an aglet on a shoelace. The device includes a first housing that is hingedly coupled to a second housing. A well is formed when the second housing is closed onto the first housing for receiving an aglet of a shoelace. In this way, the aglet is protected in the well to extend the service life of the shoelace.

(2) Description of Related Art Including Information Disclosed Under 37 CFR 1.97 and 1.98

The prior art relates to protector devices including a variety of housings that include a first section being closable on a second section for enclosing an aglet on a shoelace. The prior art discloses a variety of aglet protectors that include a sphere which insertably receives an aglet of a shoelace. In no instance does the prior art disclose an aglet protector that includes a first section that is closable on a second section and which includes a well that is defined when the first section is closed on the second section for receiving an aglet.

BRIEF SUMMARY OF THE INVENTION

An embodiment of the disclosure meets the needs presented above by generally comprising a first housing that has a first slot integrated into the first housing to insertably receive an aglet on a shoelace. A hinge is hingedly coupled to the first housing, and the hinge is biased into an open position. A second housing is provided, and a second slot is integrated into the second housing. The second housing is coupled to the hinge, such that the second housing is hingedly retained on the first housing. The second housing is positionable in a closed position, having the second slot and the first slot form a well to enclose the aglet of the shoelace.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
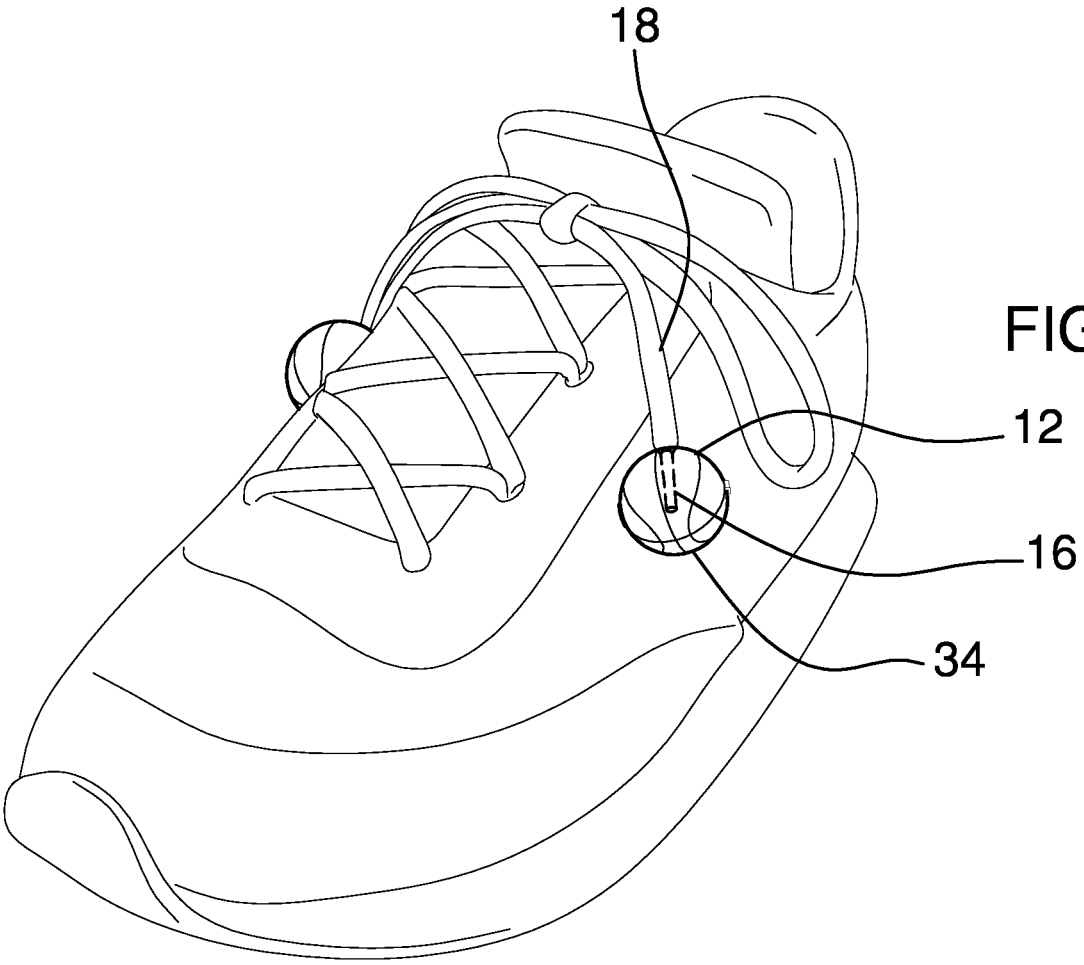
FIG. 1 is a perspective in-use view of a shoelace protector assembly according to an embodiment of the disclosure.
Figure 2:
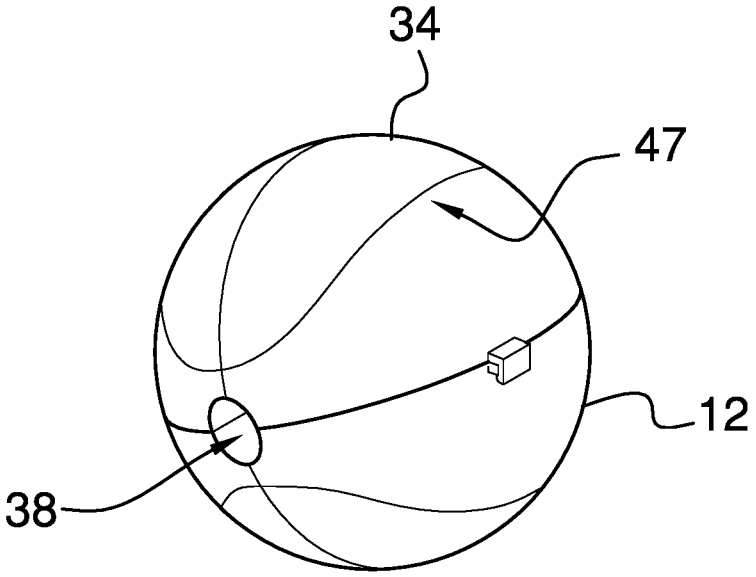
FIG. 2 is a perspective view of an embodiment of the disclosure.
Figure 3:
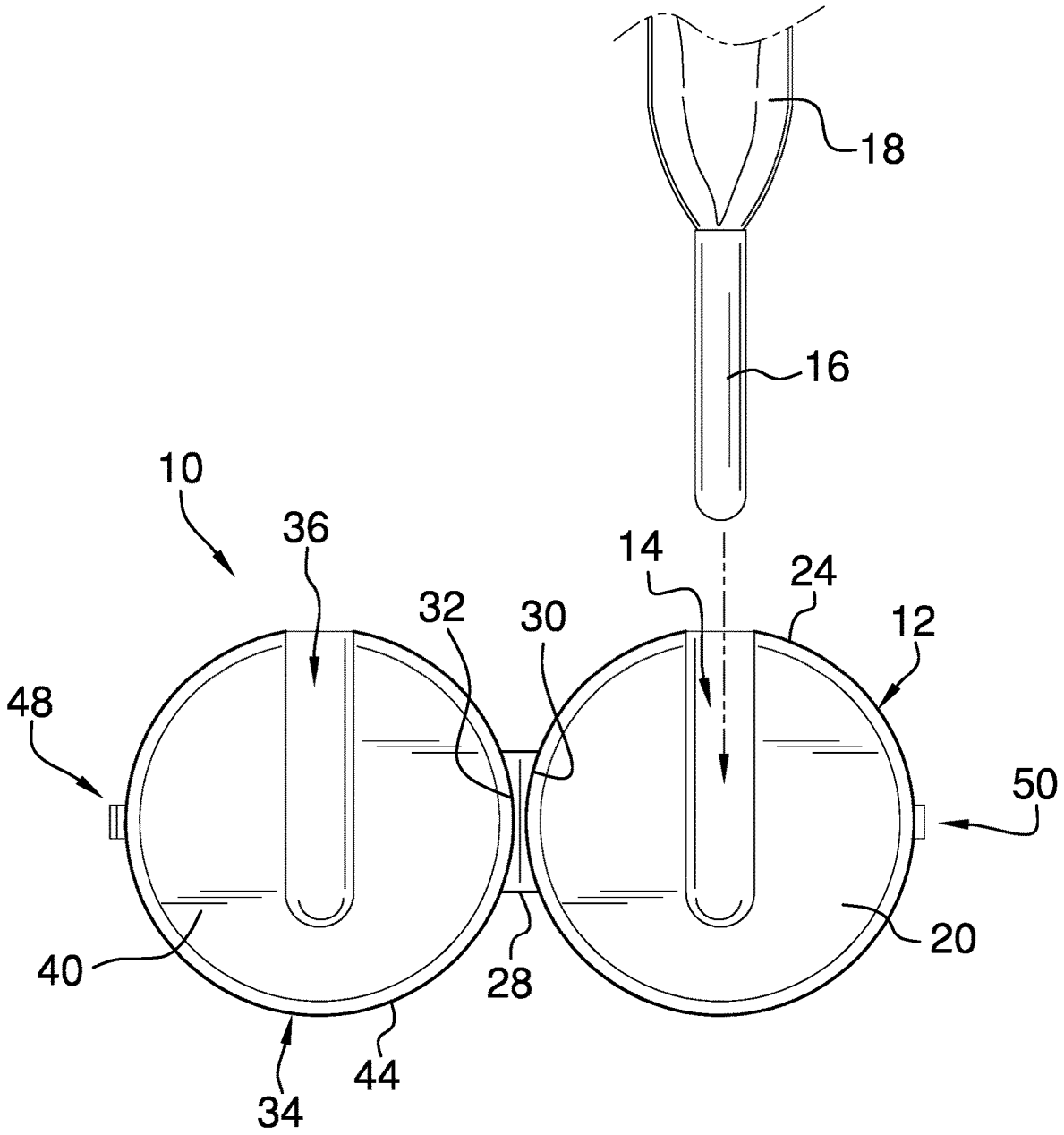
FIG. 3 is a top view of an embodiment of the disclosure showing an aglet being inserted into a first slot.
Figure 4:
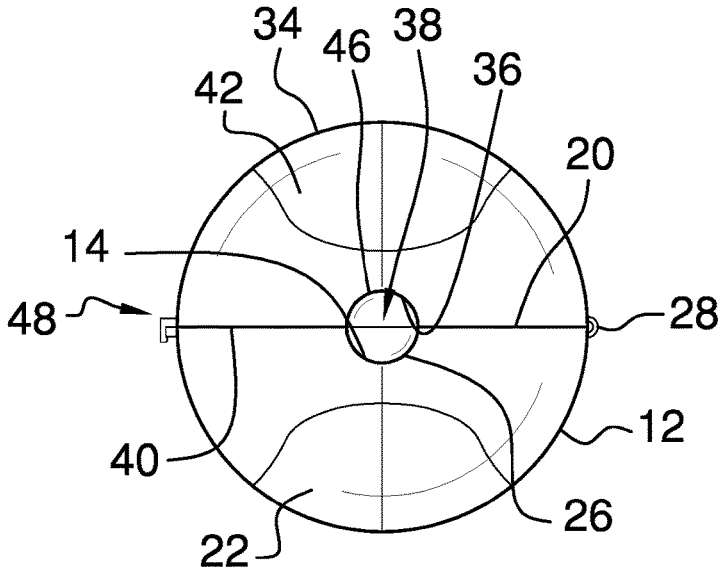
FIG. 4 is a front view of an embodiment of the disclosure showing a second housing in a closed position.

With reference now to the drawings, and in particular to FIGS. 1 through 7 thereof, a new protector device embodying the principles and concepts of an embodiment of the disclosure and generally designated by the reference numeral 10 will be described.

As best illustrated in FIGS. 1 through 7, the shoelace protector assembly 10 generally comprises a first housing 12 that has a first slot 14 integrated into the first housing 12 to insertably receive an aglet 16 on a shoelace 18. The shoelace 18 may be a shoelace of any length or design that is employed on a tennis shoe, a work boot or any other type of shoe that is tied. The first housing 12 has a first wall 20 and a second wall 22, and the first slot 14 is recessed into the first wall 20. The second wall 22 is convexly arcuate with respect to the first wall 20 such that the first housing 12 defines a hemisphere. The first wall 20 has a perimeter edge 24 that intersects the second wall 22, and the first slot 14 extends through the second wall 22 adjacent to the perimeter edge 24 to define an entry 26 into the first slot 14.

A hinge 28 is provided and the hinge 28 is hingedly coupled to the first housing 12. The hinge 28 is biased into an open position and the hinge 28 is urgeable into a closed position. The hinge 28 includes a first portion 30 that is hingedly coupled to a second portion 32. The first portion 30 is coupled to the perimeter edge 24 of the first wall 20 of the first housing 12, and the first portion 30 is positioned on an opposite side of the perimeter edge 24 from the entry 26 into the first slot 14. The hinge 28 may be a spring loaded hinge or other similar mechanism.

A second housing 34 is provided and a second slot 36 is integrated into the second housing 34. The second housing 34 is coupled to the hinge 28 such that the second housing 34 is hingedly retained on the first housing 12. Thus, the second housing 34 is positionable in a closed position having the second slot 36 being aligned with the first slot 14. In this way the first slot 14 and the second slot 36 form a well 38 that can enclose the aglet 16 of the shoelace 18. The well 38 has a diameter that is slightly less than the diameter of the aglet 16 such that the aglet 16 is compressed in the well 38. In this way the first housing 12 and the second housing 34 are retained on the aglet 16. Additionally, the second housing 34 is positionable in an open position with respect to the first housing 12.

The second housing 34 has a primary wall 40 and a secondary wall 42, and the second slot 36 is recessed into the primary wall 40. The secondary wall 42 is convexly arcuate with respect to the primary wall 40 such that the second housing 34 defines a hemisphere. The primary wall 40 has a perimeter edge 44, and the second slot 36 extends through the secondary wall 42 adjacent to the perimeter edge 44 of the primary wall 40 to define an entry 46 into the second slot 36. Additionally, the first housing 12 and the second housing 34 form a sphere when the second housing 34 is positioned in the closed position. In this way the first housing 12 and the second housing 34 enhance the ornamental appearance of the shoelace 18. The second wall 22 of the first housing 12 and the secondary wall 42 of the second housing 34 may have indicia 47 printed thereon comprising lines of a basketball. The second portion 32 of the hinge 28 is coupled to the perimeter edge 44 of the primary wall 40 of the second housing 34.

An engagement 48 is coupled to the secondary wall 42 of the second housing 34 and the engagement 48 is aligned with the perimeter edge 44 of the primary wall 40 of the second housing 34, The engagement 48 releasably engages an engagement point 50 on the second wall 22 of the first housing 12 when the second housing 34 is positioned in the closed position. In this way the second housing 34 is retained in the closed position. The engagement 48 may include a leg 52 extending away from the secondary wall 42 and a foot 54 extending away from the leg. The engagement point 50 may include a tab 56 that extends away from the second wall 22, and the foot 54 may engage the tab 56 when the second housing 34 is in the closed position.

Figure 5:
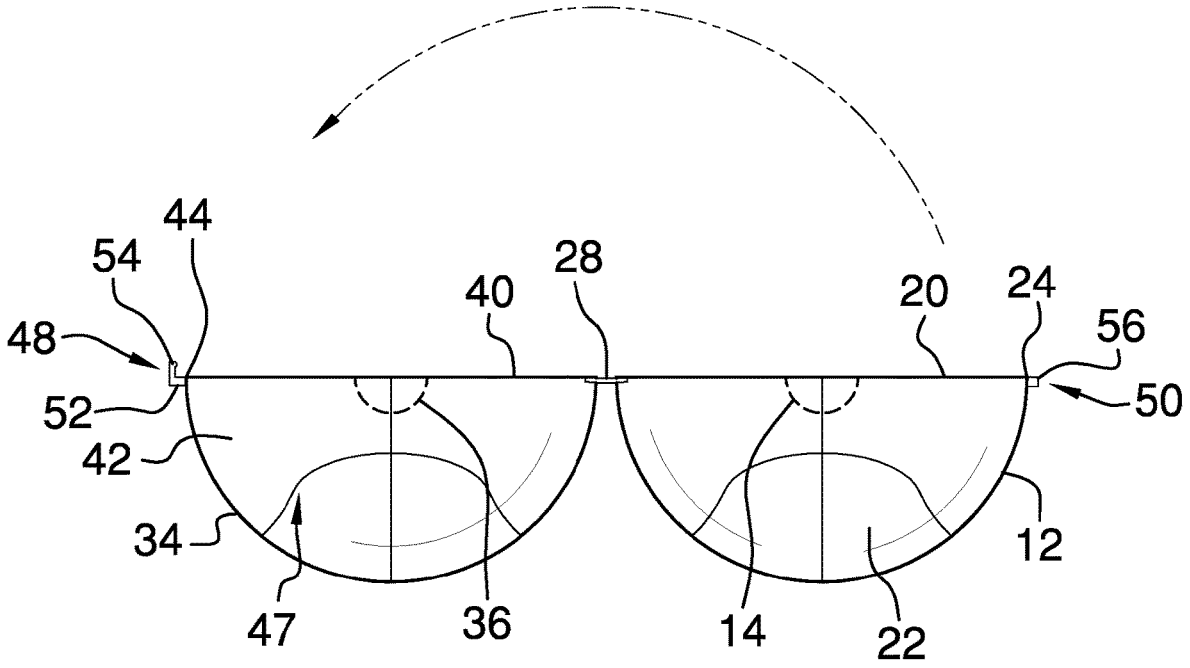
FIG. 5 is a back view of an embodiment of the disclosure showing a second housing in an open position.
Figure 6:
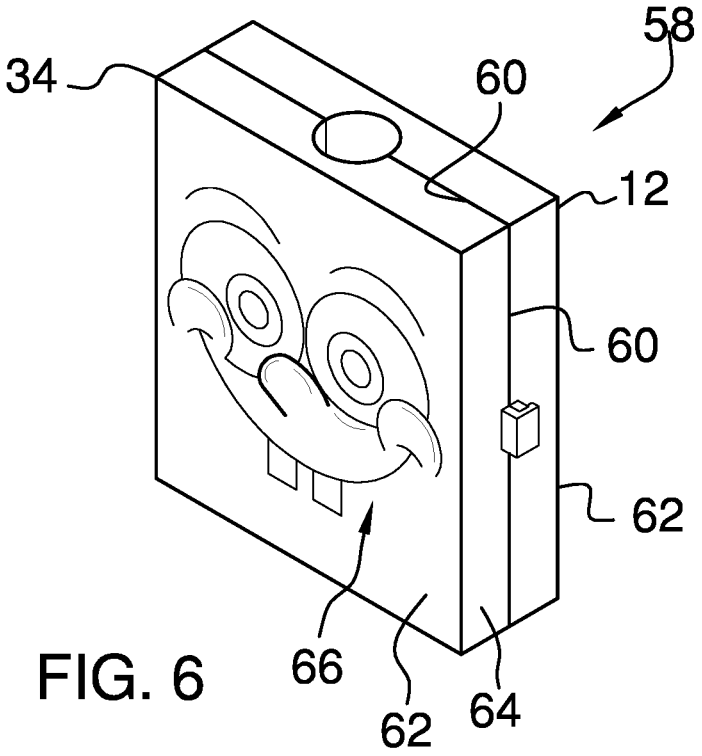
FIG. 6 is a front perspective view of an alternative embodiment of the disclosure.
Figure 7:
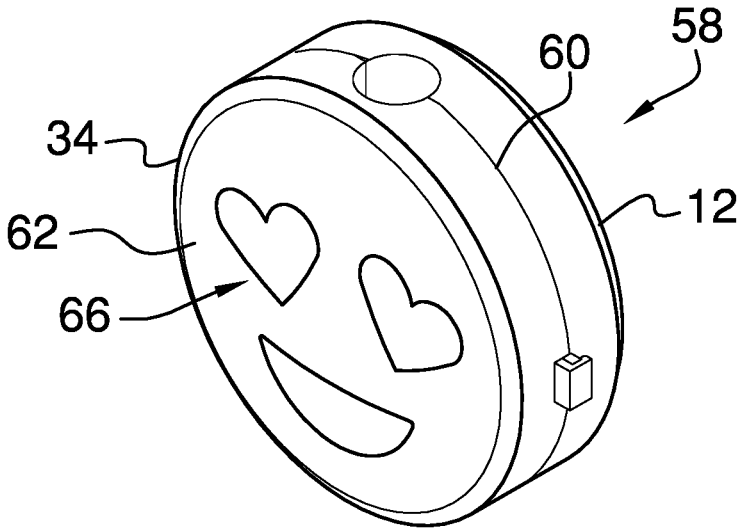
FIG. 7 is a perspective view of an alternative embodiment of the disclosure.

In an alternative embodiment 58 as is most clearly shown in FIGS. 5 and 6, each of the first housing 12 and the second housing 34 has a top wall 60, a bottom wall 62 and an outer wall 64 extending therebetween. The first slot 14 is recessed into the top wall 60 of the first housing 12 and the second slot 36 is recessed into the top wall 60 of the second housing 34. The top wall 60 of the second housing 34 abuts the top wall 60 of the first housing 12 when the second housing 34 is positioned in the closed position. The bottom wall 62 of the second housing 34 has indicia 66 printed thereon and the indicia 66 on the bottom wall 62 of the second housing 34 comprise imagery suggesting a character's face.

In use, the aglet 16 is positioned in the first slot 14 and the second housing 34 is positioned in the closed position. In this way the aglet 16 is compressed in the well 38 for retaining the first housing 12 and the second housing 34 on the aglet 16. In this way the aglet 16 is protected from being damaged thereby enhancing the service life of the shoelace 18. Additionally, the first housing 12 and the second housing 34 enhance the ornamental appearance of the shoelace 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shoelace protector assembly for enclosing an aglet on a shoelace to extend service life of the aglet, said assembly comprising:

a shoelace having an aglet;

a first housing having a first slot being integrated into said first housing to insertably receive said aglet on said shoelace, said first housing having a first wall and a second wall, said first slot being recessed into said first wall, said second wall being convexly arcuate with respect to said first wall such that said first housing defines a hemisphere, said first wall having a perimeter edge intersecting said second wall, said first slot extending through said second wall adjacent to said perimeter edge to define an entry into said first slot;

a hinge being hingedly coupled to said first housing, said hinge being biased into an open position, said hinge being urgeable into a closed position, said hinge including a first portion being hingedly coupled to a second portion, said first portion being coupled to said perimeter edge of said first wall of said first housing, said first portion being positioned on an opposite side of said perimeter edge from said entry into said first slot;

a second housing having a second slot being integrated into said second housing, said second housing being coupled to said hinge such that said second housing is hingedly retained on said first housing, said second housing being positionable in the closed position having said second slot being aligned with said first slot such that said first slot and said second slot form a well, said well having a closed end inset from respective peripheral edges of said first housing and said second housing, said well having an open end positioned along said respective peripheral edges of said first housing and said second housing, to enclose said aglet of said shoelace, said second housing being positionable in the closed position with respect to said first housing, said second housing having a primary wall and a secondary wall, said second slot being recessed into said primary wall, said secondary wall being convexly arcuate with respect to said primary wall such that said second housing defines a hemisphere, said primary wall having a perimeter edge, said second slot extending through said secondary wall adjacent to said perimeter edge of said primary wall to define an entry into said second slot, said first housing and said second housing forming a sphere when said second housing is positioned in said closed position wherein said first housing and said second housing are configured to enhance an ornamental appearance of said shoelace, said second portion of said hinge being coupled to said perimeter edge of said primary wall of said second housing; and an engagement being coupled to said secondary wall of said second housing, said engagement being aligned with said perimeter edge of said primary wall of said second housing, said engagement releasably engaging an engagement point on said second wall of said first housing when said second housing is positioned in said closed position for retaining said second housing in said closed position.

* * * * *